United States Patent [19]

Herrin

[11] Patent Number: 4,762,272

[45] Date of Patent: Aug. 9, 1988

[54] BOX FORMED FROM TWO TRAY-TYPE CONTAINERS

[76] Inventor: Lenny Herrin, c/o Regent Box Co., 15th & Huntingdon Sts., Philadelphia, Pa., 19132

[21] Appl. No.: 902,288

[22] Filed: Aug. 29, 1986

[51] Int. Cl.[4] ..... B65D 5/66

[52] U.S. Cl. ..... 229/125.08; 229/125.11; 229/125.19; 229/125.34

[58] Field of Search ..... 229/44 R, 44 CB, 23 BT, 229/45, 125.08, 125.11, 125.19, 125.34; 206/628, 623

[56] References Cited

U.S. PATENT DOCUMENTS

| | | | |
|---|---|---|---|
| 1,152,359 | 8/1915 | Smith | 229/44 R |
| 1,363,616 | 12/1920 | Reddie | 229/44 R |
| 1,895,778 | 1/1933 | Andrews | 229/44 R |
| 1,897,868 | 2/1933 | Snyder | 206/263 |
| 2,093,296 | 9/1937 | Vincent | 229/44 R |
| 2,207,567 | 7/1940 | Warner | 229/45 |
| 2,209,200 | 7/1940 | Hanson | 206/44 R |
| 2,717,731 | 9/1955 | Nerenberg | 229/44 R |
| 3,043,494 | 7/1962 | Moore | 229/87 R |
| 3,161,288 | 12/1964 | Wagner | 206/45.31 |
| 3,378,186 | 4/1968 | Thompson | 229/44 R |
| 3,465,945 | 9/1969 | Reenberg | 229/44 R |
| 3,465,946 | 9/1969 | Johnson | 229/40 |
| 3,640,449 | 2/1972 | Bastian | 229/44 R |
| 3,645,384 | 2/1972 | Wind | 206/45.34 |
| 3,659,705 | 5/1972 | Falkin | 206/45.34 |
| 3,695,514 | 10/1972 | Mascetti, Jr. | 229/2.5 |
| 3,741,843 | 6/1973 | Louis | 229/44 R |
| 3,746,242 | 7/1973 | Troth | 229/23 R |
| 3,880,280 | 4/1975 | Fyvolent | 206/44.12 |
| 4,016,972 | 4/1977 | Szamborski | 206/45.34 |
| 4,050,624 | 9/1977 | Williams | 229/44 R |
| 4,058,207 | 11/1977 | Koltz | 206/45.34 |
| 4,064,206 | 12/1977 | Seufert | 264/26 |
| 4,120,394 | 10/1978 | Soltes | 206/45.34 |
| 4,144,996 | 3/1979 | Kuckenbecker | 229/44 R |
| 4,179,252 | 12/1979 | Seufert | 425/174.6 |
| 4,228,946 | 10/1980 | Kuchenbecker | 229/44 R |
| 4,254,862 | 3/1981 | Barratt | 229/44 R |
| 4,284,193 | 8/1981 | Roccaforte | 206/45.34 |
| 4,322,001 | 3/1982 | Hurley | 206/45.34 |
| 4,331,240 | 5/1982 | Vanasse | 206/621 |
| 4,348,449 | 9/1982 | Seufert | 428/167 |
| 4,361,226 | 11/1982 | Travis | 206/45.31 |
| 4,383,607 | 5/1983 | Lordahl et al. | 206/45.34 |
| 4,403,695 | 9/1983 | Raymoure et al. | 206/497 |
| 4,408,693 | 10/1983 | Brewaeys et al. | 206/45.34 |
| 4,531,669 | 7/1985 | Osborne | 229/45 R |
| 4,545,483 | 10/1985 | Shiba et al. | 206/45.34 |
| 4,555,021 | 11/1985 | Fujii et al. | 206/45.34 |
| 4,570,790 | 2/1986 | Turnage | 229/44 R B |

FOREIGN PATENT DOCUMENTS

| | | | |
|---|---|---|---|
| 8300263 | 8/1984 | Netherlands | 229/44 R |

*Primary Examiner*—Willis Little

*Attorney, Agent, or Firm*—Panitch, Schwarze, Jacobs and Nadel

[57] ABSTRACT

A box formed from two tray-type containers. The first tray-type container is generally parallelogram-shaped and is formed from a single sheet of polymeric plastic material, including front, back, and side panels of predetermined heights and lengths. Tab members extend between and join together the side panels with the front and back panels. A connection panel extends outwardly from the unattached end of the back panel of the first tray-type container. A second tray-type container sized to fit within the first tray-type container is generally parallelogram-shaped and formed from a single sheet of polymer material, including front, back and side panels of predetermined heights and lengths. Tab members extend between and join together the side panels with the front and back panel. In forming the box of the present invention, the attaching means connect the connection panel of the first tray-type container to the base panel of the second tray-type container proximate in edge formed between the base panel and the back panel. Upon attachment, the connector panel forms a hinge to connect the first and second tray-type containers, whereby the first tray-type container can be secured in an open, predetermined position and closed about the second tray-type container. In alternative embodiments, sealing panels extend outwardly from the unattached edge of the back, front and side panels of the first tray-type container. The sealing panels are attached to the corresponding surface of the base panel of the second tray-type container and cooperate with the connection panel to make the box tamper-resistant.

10 Claims, 4 Drawing Sheets

BOX FORMED FROM TWO TRAY-TYPE CONTAINERS

BACKGROUND OF THE INVENTION

This invention relates to a box formed from the combination of two polymeric tray-type containers using a hinge which permits the box to be opened and remain at varying open positions.

In the packaging field, there exists a need for inexpensive products which can be easily adapted for display purposes to increase merchandising. This is particularly true of those products where visual impact is a major component in sales appeal. For example, such products may include clothing, accessories, art supplies, and video cassettes. Furthermore, there is a need for packaging which can be made tamper-proof, yet provides the customer with visual access to the contents.

The present invention provides a box of structural integrity to protect its contents without hampering visual inspection by potential customers. The top and bottom of the box are held together on one side by a connection panel which cooperates with other panels and a special multi-adjustable hinge to allow the box to be opened and to remain open in varying positions. In one form, the box can be made tamper-resistant by the use of multiple connection panels. Thus, forced entry or damage to the container can easily be discerned by visual inspection.

SUMMARY OF THE INVENTION

Briefly stated, the present invention is a box formed from two tray-type containers. A first tray-type container is generally parallelogram shaped and is formed from a single sheet of polymeric plastic material, including front, back, and side panels of predetermined heights and lengths. Tab members extend between and join together the side panels with the front and back panels. A connection panel extends outwardly from the unattached end of the back panel of the first tray-type container. A second tray-type container sized to fit within the first tray-type container is generally parallelogram-shaped and formed from a single sheet of polymer material, including front, back and side panels of predetermined heights and lengths. Tab members extend between and join together the side panels with the front and back panels. In forming the box of the present invention, attaching means connect the connection panel of the first tray-type container to the base panel of the second tray-type container proximate an edge formed between the base panel and the back panel. Upon attachment, the connection panel forms a hinge to connect the first and second tray-type containers, whereby the first tray-type container can be secured in an open, predetermined position and closed about the second tray-type container. In alternative embodiments, sealing panels extend outwardly from the unattached edge of the back, front and side panels of a first tray-type container. The sealing panels are attached to the corresponding surface of the base panel of the second tray-type container and cooperate with the connection panel to make the box tamper-resistant.

DESCRIPTION OF PREFERRED EMBODIMENT

Figure 2:
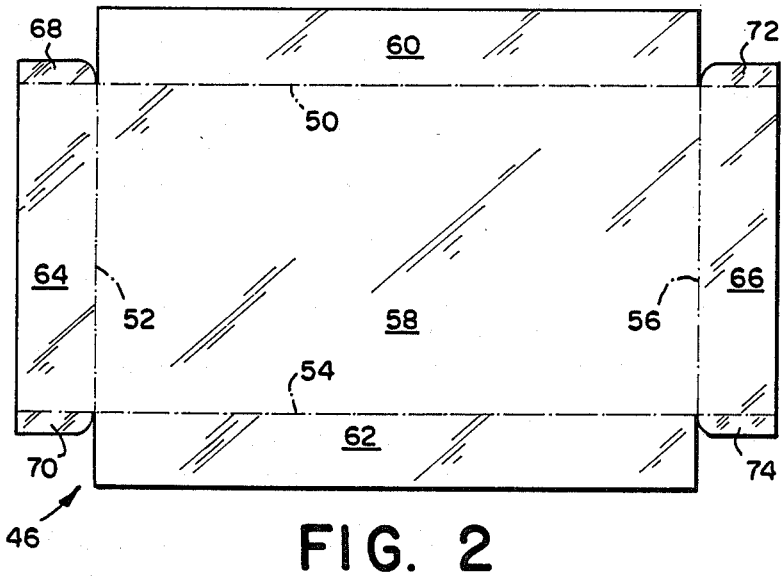
FIG. 2 is a top plan view of a blank for forming a second tray-type container.
Figure 1:
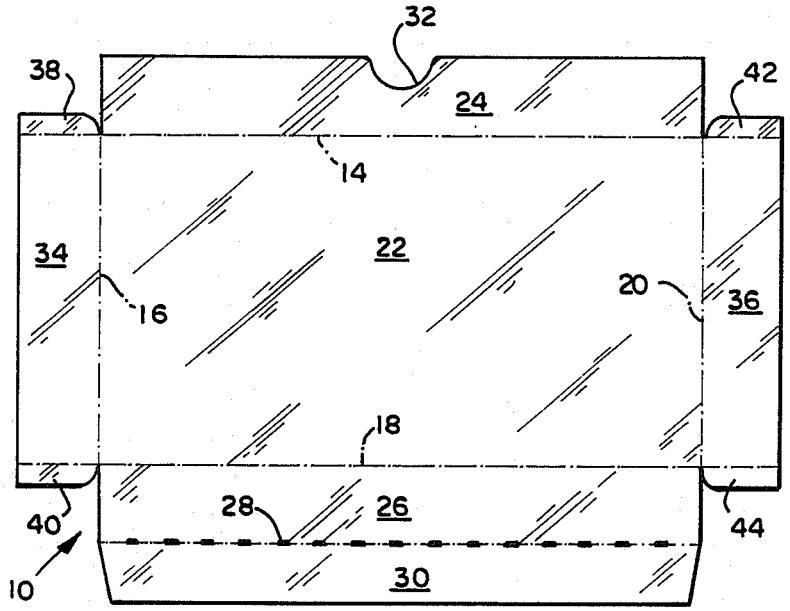
FIG. 1 is a top plan view of a blank for forming a first tray-type container.
Figure 3:
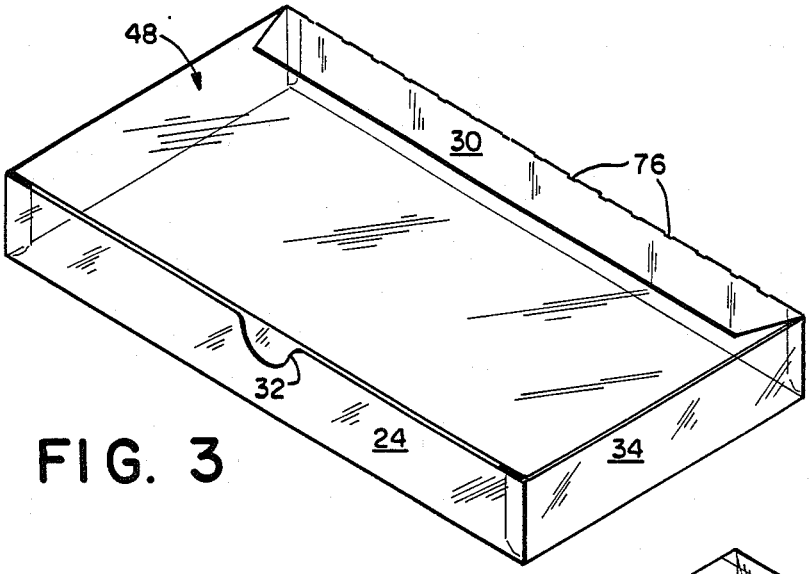
FIG. 3 is an inverted perspective view of a box formed in accordance with the present invention.
Figure 4:
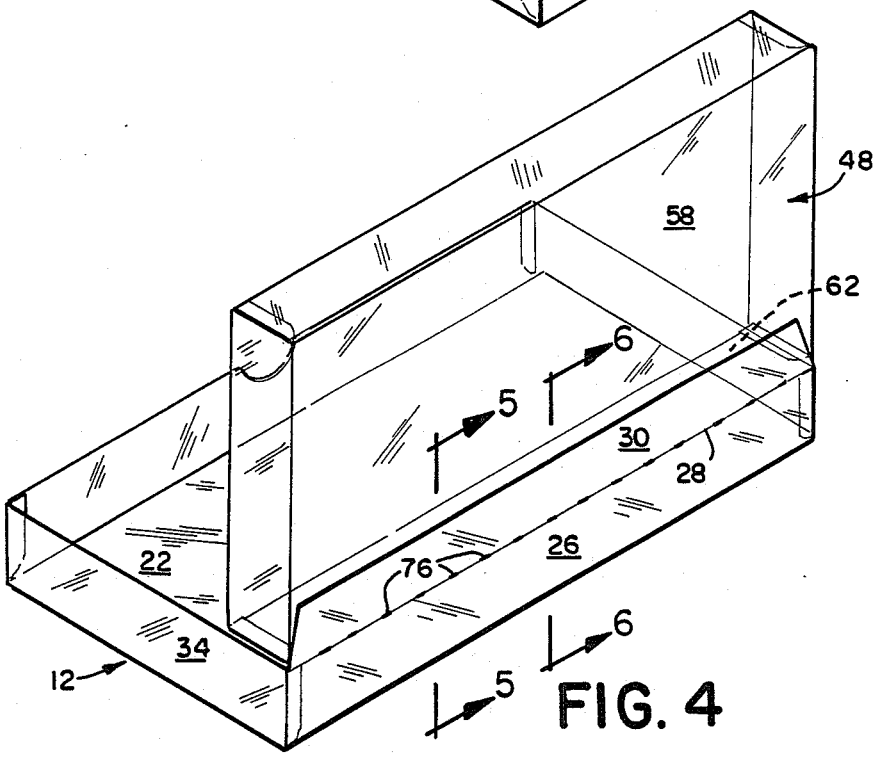
FIG. 4 is an inverted perspective view of the box of FIG. 3 in an open position.
Figure 5:
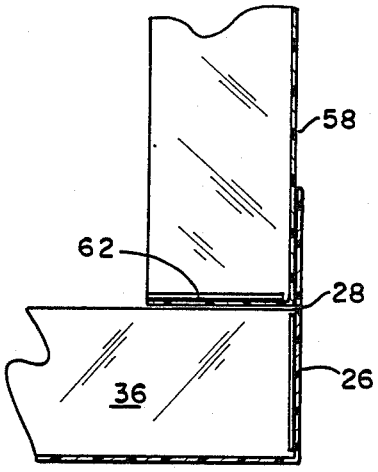
FIG. 5 is a partial sectional view of the box of FIG. 4 taken along line 5—5 of FIG. 4.
Figure 6:
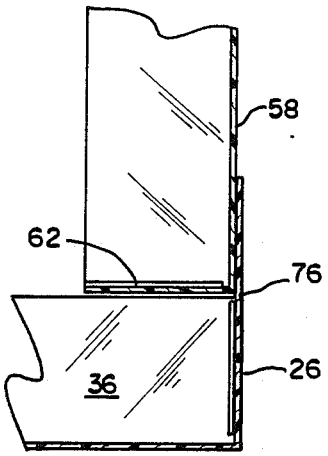
FIG. 6 is a partial sectional view of the box of FIG. 4 taken along line 6—6 of FIG. 4.

Referring to the drawings in detail, wherein like numerals indicate like elements throughout, there is shown in FIGS. 1 through 6 a first preferred embodiment of a box in accordance with the present invention shown in both blank and assembled forms. FIG. 1 illustrates a first one-piece blank 10 which is used to form a first tray-type container or top tray container 12 (FIG. 4). The blank 10 is formed from a single sheet of polymeric plastic material or the like and preferably has a thickness of about 0.008 inches to 0.012 inches. The polymeric material is initially flexible, or can be made flexible utilizing known chemical and/or mechanical techniques and/or means.

The blank 10 includes a base panel 22. The base panel 22 is generally parallelogram-shaped and has a predetermined length and width. While in the present embodiment the base panel 22 is shown as being generally rectangular, it could be square. The base panel 22 is generally centrally located within the blank 10 and is bordered by score lines 14, 16, 18, and 20. Front and back panels 24, 26, respectively, are disposed on opposed sides of the base panel 22 and extend from score lines 14, 18, respectively. The front and back panels 24, 26 generally have a uniform width or height and a uniform length generally corresponding to the length of the base panel 22. The back panel 26 is bounded by the fold line 28 on one side and score line 18 on the other side. A connection panel 30 extends outwardly from the fold line 28 of the unattached edge of the back panel 26. The connection panel 30 generally has a length corresponding to the length of the base panel 22. The connection panel has a predetermined width or height to provide adequate attachment to the second tray-type container 48 and is sized relative to the width or height of the front and back panels 24, 26.

In the preferred embodiment, a semicircular notch 32, as illustrated in FIG. 1, is excised from the edge of and proximate the mid-length of the front panel 24. The notch 32 is provided to facilitate opening and closing of the box.

A pair of side panels 34 and 36 are disposed on opposed sides of the base panel 22 and extend from score lines 16, 20, respectively. The side panels 34 and 36 are of substantially the same width or height as the front and back panels 24, 26, and have a length generally corresponding to the width of the base panel 22.

In forming the top tray-type container 12, the front and back panels 24 and 26 are folded along score lines 14 and 18 to extend generally perpendicular to the base panel 22. The side panels 34 and 36 are correspondingly folded along score lines 16 and 20 to extend generally perpendicular to the base panel 22. In the presently preferred embodiment, tab members 38, 40, 42 and 44, generally rectangular in shape, extend from each of the ends of the side panels 34 and 36. The tab members 38, 40, 42, 44 are folded along score lines 14 and 18 to extend generally perpendicular to the corresponding side panels 34 and 36 and are secured to the front and back panels 24, 26 to join together the front, back and side panels 24, 26, 34 and 36 as shown in FIG. 4. The tab members 38, 40, 42 and 44 are joined flush to and within the same plane as the respective front and back panels 24, 26.

The means for attaching the tab members 38, 40, 42 and 44 with the corresponding front and back panels 24 and 26 in the present embodiment comprises a liquid glue formed from a chemical solvent mixture. However, it will be appreciated by those skilled in the art that other means may be used for joining the tab members 38, 40, 42 and 44 to the front and back panels 24 and 26. It should be also understood that the tab members may alternatively extend from the ends of the front and back panels 24 and 26 or may be separate members not initially connected to any of the panels. As illustrated in FIG. 4, the folded panels of the blank member 10 when joined, form a first tray-type container, or top tray container 12.

FIG. 2 illustrates a second one-piece blank 46 which is used to form a second tray-type container or bottom tray-type container 48 (FIG. 4). The second tray-type container 48 is sized to fit within the first tray-type container 12, as shown in FIGS. 3 and 4. The blank member 46 is also formed from a single sheet of polymeric plastic material or the like, and preferably having the same thickness as blank 10. The blank 46 is substantially the same as blank 10 described above and includes a base panel 58. Generally base panel 58 is parallelogram in shape, having a predetermined length and width. The base panel 58 is bordered by the score lines 50, 52, 54 and 56. Front and back panels, 60, 62 of a uniform height and a length generally corresponding to the length of the base panel 58 are disposed on opposed sides of base panel 58. A pair of side panels 64, 66 of substantially the same height as the front and back panels 60, 62 are disposed on opposed sides of the base panel 58. The side panels 64, 66 have a length generally corresponding to the width of the base panel 58 and include tab members 68, 70, 72 and 74.

The bottom tray-type container 48 is formed as shown in FIGS. 3 and 4 in substantially the same manner as the top tray-type container described above.

In forming the box of the present invention, the second tray-type container 48 is installed within the first tray-type container 12, as illustrated in FIG. 3. In order to initiate attachment of the first tray-type container 12 with the second tray-type container 48, the connection panel 30 of the first tray-type container 12 is folded along fold line 28 toward the base panel 58 of the second tray-type container 48. The connection panel 30 includes spaced perforations 76 along fold line 28. The connection panel 30, as illustrated in FIGS. 3 and 4, is attached to the base panel 58 proximate an edge formed between the base panel 58 and back panel 62. In the preferred embodiment, the means for attaching the connection panel 30 comprises a liquid glue formed from a chemical solvent mixture Of course, other attachment means could alternatively be utilized.

The attached connection panel 30 cooperates with the other panels to form a hinge to interconnect the first and second tray-type containers 12, 48, respectively. The hinge resists high levels of shear stress and prevents the first and second tray-type containers 12, 48 from becoming disengaged without visibly disrupting the integrity of the box.

A portion of the hinge is comprised of spaced multiple perforations 76 which extend along fold line 28. The perforations 76 cooperate with the spaces between the perforations to give the hinge a "memory" which permits the first tray-type container 12 to remain in variable open positions relative to the second tray-type container 48. The number, length and spacing of the perforations 76 may be adjusted to permit the first tray-type container 12 to remain in a desired open position or to close about the second tray-type container 48, depending on the utilization of the box.

Figure 8:
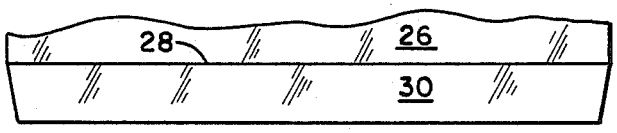
FIG. 8 is a top plan view of the connection panel of a second tray-type container.

Alternatively, a creasing process can be used to form a hinge without perforations along fold line 28 as shown in FIG. 8. The creasing process also forms a hinge with a "memory" which permits the first tray-type container to remain in variable open positions relative to the second tray-type container 48. In the creasing process, two types of creases, a hard and a soft crease, can be utilized to form the hinge. A hard crease is formed by scoring the fold line 28 with a rounded cutting tool to partially fracture the polymeric material. In contrast, a soft crease is formed by using a high frequency electric field in conjunction with a forming tool to induce bending of the polymeric material. It will be apparent to those skilled in the art that alternative processes can be employed to form the hinge of the box. Thus, the present invention is not limited to the specifically disclosed processes, but is intended to cover all modifications which are within the scope and spirit of the present invention.

Figure 7:
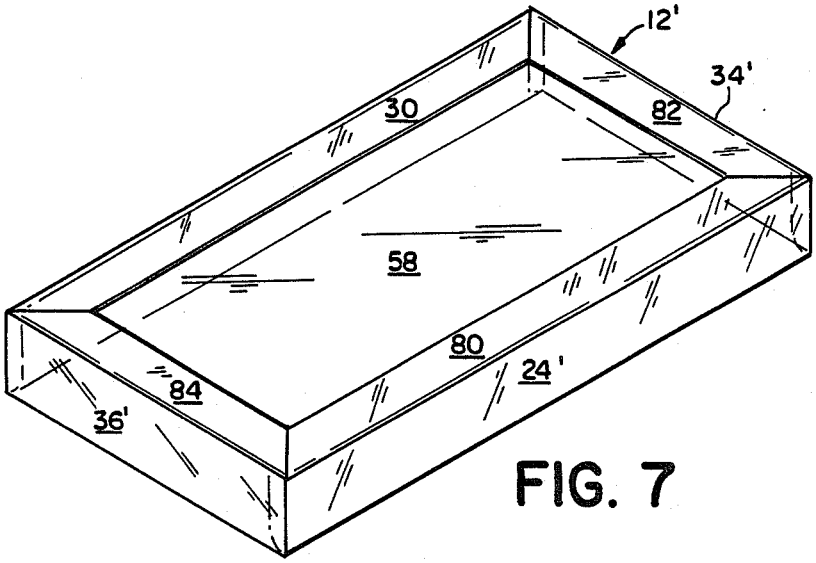
FIG. 7 is an inverted perspective view of a box with multiple connection panels in accordance with an alternate embodiment of the present invention.

In an alternate embodiment illustrated in FIG. 7, sealing panels 80, 82 and 84 extend from the front and side panels 24', 34' and 36', respectively, or any combination thereof. The sealing panels 80, 82 and 84 are attached to the edges of the front and side panels 24', 34' and 36' of the top tray-type container 12' and are folded in substantially the same manner as the connection panel 30. When the top and bottom tray-type containers are assembled together, the sealing panels 80, 82 and 84 are attached to the base panel 58 of the bottom tray-type container proximate the edges formed between the respective front, back and side panels and the base panel 58 in the same manner that the connection panel 30 is attached. The ends of the connection panel 30 and the sealing panels 80, 82 and 84 may be mitered as shown in FIG. 7 to facilitate attachment. The connection panel 30 and the sealing panels 80, 82 and 84 cooperate and serve as a tamper-proof means. Therefore, the box of the present invention cannot be breached without visibly disrupting the structural integrity of the box. Of course, it will be recognized by those skilled in the art that a lesser number of sealing panels may be employed, for example, only a single sealing panel 80.

From the foregoing description, it can be seen that the present invention comprises a box formed from two tray-type containers. It will be recognized by those skilled in the art that changes may be made to the above-described embodiments of the invention without departing from the broad inventive concept thereof. It is understood, therefore, that this invention is not limited to the particular embodiments disclosed, but is intended to cover all modifications which are within the scope and spirit of the invention as defined by the appended claims.

I claim:

1. A box formed from two tray-type containers, the box comprising:

a first tray-type container formed from a single sheet of polymeric plastic material including a parallelogram shaped base panel having a predetermined length and width, front and back panels of substantially the same height as the front and back panels and a length generally corresponding to the length of the base panel, the front and back panels on opposd sides of the base panel and folded to extend generaly perpendicularly to the base panel, a pair of side panels of substantially the same height as the front and back panels and of a length generally corresponding to the width of the base panel, the side panels on opposed sides of the base panel, tab members extending between and joining together said side panels and said front and back panels to form said tray-type container, and a connection panel extending outwardly from an unattached edge of the back panel;

a second tray-type container sized to fit within the first tray-type container and formed from a sheet of polymeric plastic material including a parallelogram-shaped base panel having a predetermined length and width, front and back panels of a length generally corresponding to the length of the base panel, the front and back panels on opposed sides of the base panel and folded to extend generally perpendicular to the base panel, a pair of side panels of a length generally corresponding to the width of the base panel, the side panels on opposed sides of the base panel and folded generally perpendicular to the base panel, tab members extending between and joining together said side panels and said front and back panels to form said tray-type container, the connection panel being folded along a fold line toward and attached to the base panel of the second tray-type container proximate an edge formed between the base panel and the back panel, the connection panel including spaced perforations along the fold line; and means for attaching the connection panel of the first tray-type container to the base panel of the second tray-type container, said connection panel forming a hinge to interconnect the first and second tray-type containers, the spaced perforations cooperating with the spaces between the perforations to give the hinge a memory whereby the box may be opened by pivoting one of the tray-type containers with respect to the other of the tray-type containers about the hinge, the hinge memory operating to permit the first container to remain in a desired open position with respect to the second container.

2. The box as recited in claim 1 further including a first sealing panel extending outwardly from an unattached edge of the front panel of the first tray-type container, the sealing panel being folded toward and attached to the base panel of the second tray-type container proximate an edge formed between the base panel and the front panel, whereby the first tray-type container is securely closed about the second tray-type container.

3. The box as recited in claim 2 further including a second sealing panel extending outwardly from an unattached edge of at least one side panel of the first tray-type container, the second sealing panel being folded toward and attached to the base panel of the second tray-type container proximate an edge formed between the base panel and the corresponding side panel, whereby the first tray-type container is securely closed about the second tray-type container.

4. The box as recited in claim 1 further including a sealing panel extending outwardly from an unattached edge of at least one side panel of the first tray-type container, the sealing panel being folded toward and attached to the base panel of the second tray-type container proximate an edge formed between the base panel and the side panel, whereby the first tray-type container is securely closed about the second tray-type container.

5. The box as recited in claim 1 wherein a length of each of the perforations along the fold line of the connection panel is greater than a distance between adjacent perforations.

6. The box as recited in claim 1 wherein a length of each of the perforations along the fold line of the connection panel is less than a distance between adjacent perforations.

7. The box as recited in claim 1 wherein a length of each of the perforations along the fold line of the connection panel is substantially equal to a distance between adjacent perforations.

8. A box formed from two tray-type containers, the box comprising:

a first tray-type container formed from a single sheet of polymeric plastic material including a parallelogram shaped base panel having a predetermined length and width, front and back panels of substantially the same height as the front and back panels and a length generally corresponding to the length of the base panel, the front and back panels on opposed sides of the base panel and folded to extend generally perpendicularly to the base panel, a pair of side panels of substantially the same height as the front and back panels and of a length generally corresponding to the width of the base panel, the side panels on opposed sides of the base panel, tab members extending between and joining together said side panels and said front and back panels to form said tray-type container, and a connection panel extending outwardly from an unattached edge of the back panel;

a second tray-type container sized to fit within the first tray-type container and formed from a sheet of polymeric plastic material including a parallelogram-shaped base panel having a predetermined length and width, front and back panels of a length generally corresponding to the length of the base panel, the front and back panels on opposed sides of the base panel and folded to extend generally perpendicular to the base panel, a pair of side panels of a length generally corresponding to the width of the base panel, the side panels on opposed sides of the base panel and folded generally perpendicular to the base panel, tab members extending between and joining together said side panels and said front and back panels to form said tray-type container, the connection panel being folded along a fold line toward and attached to the base panel of the second tray-type conntainer proximate an edge formed between the base panel and the back panel, the connection panel including a core along the fold line; and means for attaching the connection panel of the first tray-type container to the base panel of the second tray-type container, said connection panel forming a hinge to interconnect the first and second tray-type containers, the score line giving the hinge a memory whereby the box may be opened by pivoting one of the tray-type containers with respect to the other of the tray-type containers about the hinge, the hinge memory operating to permit the first container to remain in a desired open position with respect to the second container.

9. A box formed from two tray-type containers, the box comprising:

a first tray-type container formed from a single sheet of polymeric plastic material including a parallelogram-shape base panel having a predetermined length and width, front and back panels of substantially the same height as the front and back panels and a length generaly corresponding to the length of the base panel, the front and back panels on opposed sides of the base panel and folded to extend generally perpendicularly to the base panel, a pair of side panels of substantially the same height as the front and back panels and of a length generally corresponding to the width of the base panel, the side panels on opposed sides of the base panel, tab members extending between and joining together said side panels and said front and back panels to form said tray-type container, and a connection panel extending outwardly from an unattached edge of the back panel;

a second tray-type container sized to fit within the first tray-type container and formed from a sheet of polymeric plastic material including a parallelogram-shaped base panel having a predetermined length and width, front and back panels of a length generally corresponding to the length of the base panel, the front and back panels on opposed sides of the base panel and folded to extend generally perpendicular to the base panel, a pair of side panels of a length generally corresponding to the width of the base panel, the sides panels on opposed sides of the base panel and folded generally perpendicular to the base panel, tab members extending between and joining together said side panels and said front and back panels form said tray-type container, the connection panel being folded along a fold line toward and attached to the base panel of the second tray-type container proximate an edge formed between the base panel and the back panel, the connection panel including a soft crease along the fold line; and means for attaching the connection panel of the first tray-type container to the base panel of the second tray-type container, said connection panel forming a hinge to interconnect the first and second tray-type containers, the soft crease giving the hinge a memory whereby the box may be opened by pivoting one of the tray-type containers with respect to the other of the tray-type containers about the hinge, the hinge memory operating to permit the first container to remain in a desired open position with respect to the second container.

10. A box formed from two tray-type containers, the box comprising:

a first tray-type container formed from a single sheet of polymeric plastic material including a parallelogram-shaped base panel having a predetermined length and width, front and back panels of substantially the same height as the front and back panels and a length generally corresponding to the length of the base panel, the front and back panels on opposed sides of the base panel and folded to extend generally perpendicularly to the base panel, a pair of side panels of substantially the same height as the front and back panels and of a length generally corresponding to the width of the base panel, the side panels on opposed sides of the base panel, tab members extending between and joining together said side panels and said front and back panels to form said tray-type container, and a connection panel extending outwardly from an unattached edge of the back panel;

a second tray-type container sized to fit within the first tray-type container and formed from a sheet of polymeric plastic material including a parallelogram-shaped base panel having a predetermined length and width, front and back panels of a length generally corresponding to the length of the base panel, the front and back panels on opposed sides of the base panel and folded to extend generally perpendicular to the base panel, a pair of side panels of a length generally corresponding to the width of the base panel, the side panels on opposed sides of the base panel and folded generally perpendicular to the base panel, tab members extending between and joining together said side panels and said front and back panels to form said tray-type container, the connection panel being folded along a fold line toward and attached to the base panel of the second tray-type container proximate an edge formed between the base panel and the back panel, the connection panel including a hard crease along the fold line; and means for attaching the connection panel of the first tray-type container to the base panel of the second tray-type container, said connection panel forming a hinge to interconnect the first and second tray-type containers, the hard crease giving the hinge a memory whereby the box may be opened by pivoting one of the tray-type containers with respect to the other of the tray-type containers about the hinge, the hinge memory operating to permit the first container to remain in a desired open position with respect to the second container.

* * * * *